United States Patent [19]

Rytand

[11] Patent Number: 4,709,647

[45] Date of Patent: Dec. 1, 1987

[54] FLOATING DOCK

[76] Inventor: David H. Rytand, 2402 Killarney Way, S.E., Bellevue, Wash. 98004

[21] Appl. No.: 816,204

[22] Filed: Jan. 6, 1986

[51] Int. Cl.[4] ..... B63B 35/38

[52] U.S. Cl. ..... 114/267; 114/263; 114/266; 405/219

[58] Field of Search ..... 114/263, 264, 266, 267; 405/218–221; 52/223 L, 227, 125.1, 125.4

[56] References Cited

U.S. PATENT DOCUMENTS

| | | | |
|---|---|---|---|
| 2,879,735 | 3/1959 | Pointer | 114/352 X |
| 3,012,533 | 12/1961 | Tellefsen | 114/267 |
| 3,073,274 | 1/1963 | Lamb . | |
| 3,091,203 | 5/1963 | Usab | 114/266 |
| 3,157,144 | 11/1964 | De Jarnett | 114/267 |
| 3,179,076 | 4/1965 | Sheffield | 114/267 |
| 3,323,479 | 6/1967 | Filak . | |
| 3,448,709 | 6/1969 | Hardwick, Jr. | 114/266 |
| 3,580,202 | 5/1971 | Thompson | 114/266 |
| 3,951,085 | 4/1976 | Johnson et al. | 114/267 X |
| 3,977,344 | 8/1976 | Holford | 114/263 |
| 4,223,629 | 9/1980 | Dunlop . | |
| 4,260,293 | 4/1981 | Peterson . | |
| 4,316,426 | 2/1982 | Meeusen . | |
| 4,318,361 | 3/1982 | Sluys . | |
| 4,318,362 | 3/1982 | Jung . | |
| 4,353,320 | 10/1982 | Sluys . | |
| 4,365,914 | 12/1982 | Sluys | 114/267 X |
| 4,418,634 | 12/1983 | Gerbus . | |

FOREIGN PATENT DOCUMENTS

| | | | |
|---|---|---|---|
| 800802 | 12/1968 | Canada | 114/263 |
| 2055703 | 3/1981 | United Kingdom | 114/267 |

*Primary Examiner*—Joseph F. Peters, Jr.
*Assistant Examiner*—Paul E. Salmon
*Attorney, Agent, or Firm*—Klarquist, Sparkman, Campbell, Leigh & Whinston

[57] ABSTRACT

A floating dock includes a plurality of float modules comprised of containers having opposing walls, a deck with opposing edges mounted in spaced relationship above the float modules, and a pair of wales extending along opposing walls of the float modules and opposing edges of the dock. Compression rods extend between the wales above the modules and act on the pair of wales such that the compression rods exert compression force on the float modules and deck. A compression beam extends between the opposing walls of the container below the compression rod to create a box beam in combination with the wales and deck, therefore rigidifying the dock to enhance its portability on land and wave resistance properties in water. The float modules are spaced apart longitudinally of the dock to allow wave transparency and wash space for debris. A reinforcing bar extends through the walls of each float module, and lifting loops are supported by the reinforcing bar and extend upwardly from each float module for securing the compression rods and for attachment to lifting hooks. The space between the deck and float modules forms a passageway for utility conduits.

18 Claims, 8 Drawing Figures

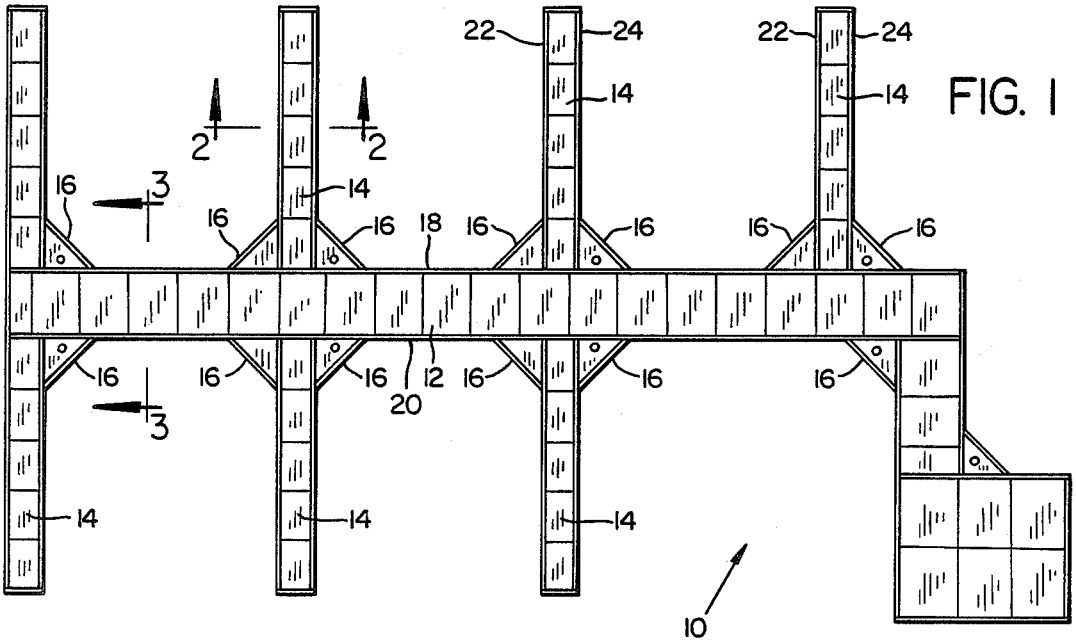
FIG. 1
FIG. 2
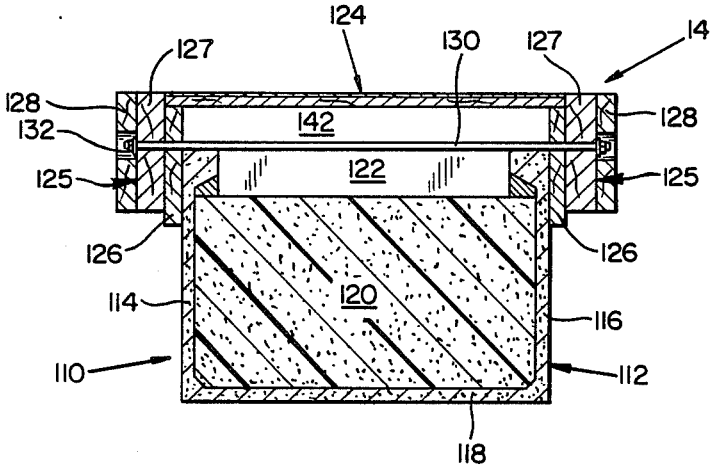
FIG. 3
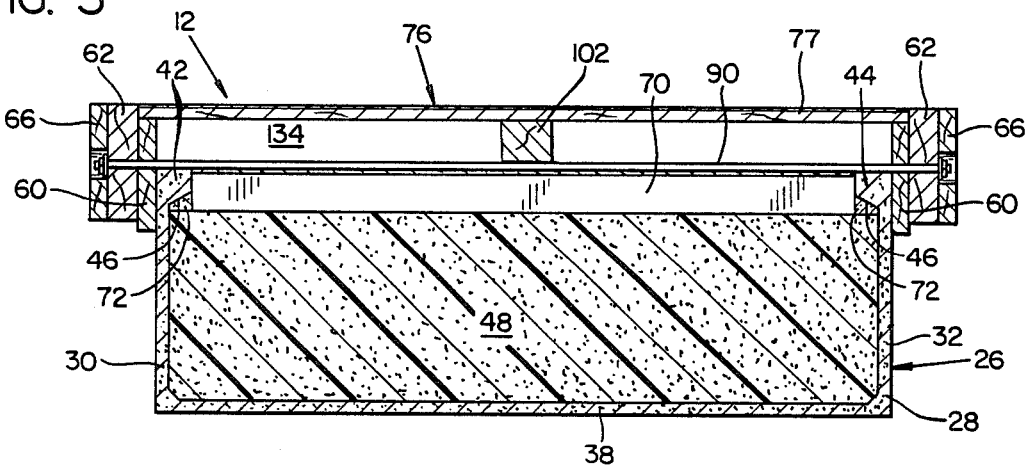

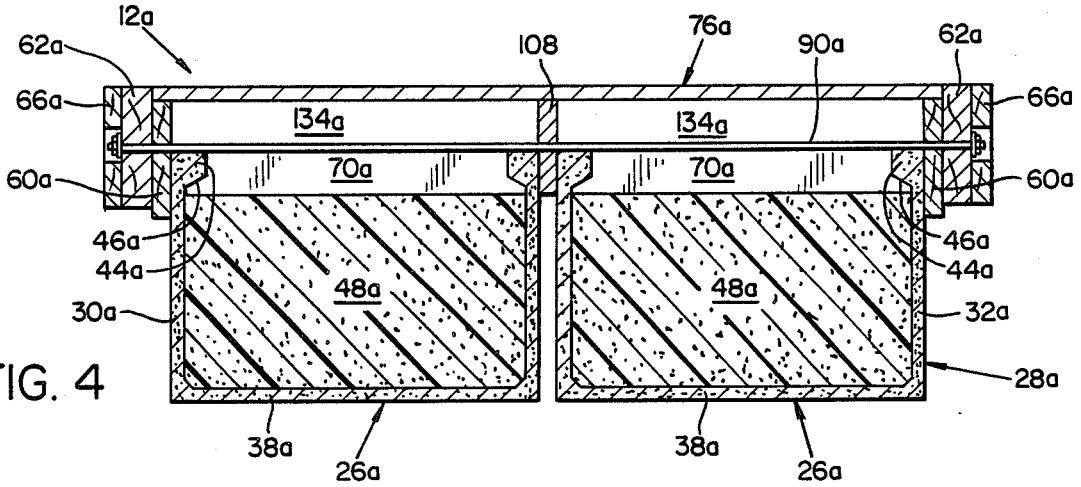
FIG. 4
FIG. 8
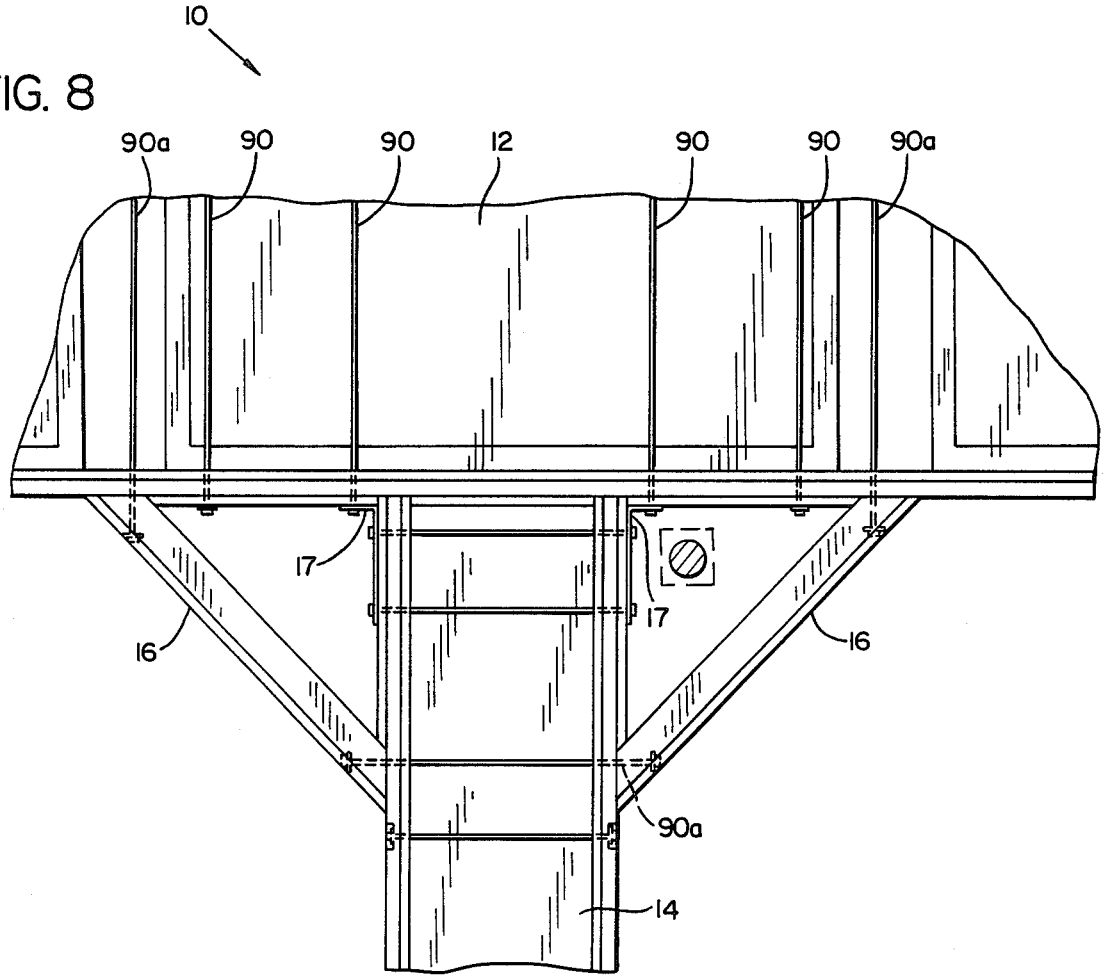

FLOATING DOCK

BACKGROUND OF THE INVENTION

1. Field of the Invention

This invention concerns floating docks and is more particularly concerned with floating docks having a utility passageway through which utility conduits are routed.

2. General Discussion of the Background

Floating boat docks are commonly constructed by securing a number of rectangular marine floats to each other. Boats are then moored alongside the floats, where it is desirable to provide them with utility services such as electricity, water, sewage, and telephone. Boat docks which supply such services have already been developed.

For example, U.S. Pat. No. 4,353,320 discloses a dock utilizing a marine float having a concrete casing completely surrounding a core of buoyant foam. A utility trench extends longitudinally along the float. One or more compression rods interconnect each longitudinal wall of the float to compressively load the float and enhance its strength. All of the dock's freeboard must also be provided by the float itself, therefore requiring a large, heavy concrete casing that has sufficient displacement to hold the deck of the float out of the water. Finally, the dock is structurally weak at the center of the deck because of the presence of the longitudinal trench in the float.

U.S. Pat. No. 4,318,362 shows a floating concrete dock having a deck portion with a plurality of buoyant floats immediately beneath the deck. The docks are cast with prestressed tendons extending longitudinally to maintain it under longitudinal compression.

U.S. Pat. Nos. 3,073,274 and 4,316,426 both disclose floating docks having decks spaced above floating members. Neither of these structures, however, place the floats and deck under horizontal compression. Absence of such compression allows the dock to bend under the influence of wave forces, eccentric or cantilever loads, and other influences.

It is accordingly an object of this invention to provide an improved floating dock having a utility passageway through which utility conduits may be placed.

Another object of the invention is to provide a dock which can be compressively loaded to enhance its strength and resistance to wave action.

Yet another object of the invention is to provide a rigidified floating dock which spans waves and can be easily transported.

Still another object of the invention is to provide a dock in which nails, screws, or other fasteners cannot work their way above the surface of the deck thereof under torsional forces.

Even yet another object of the invention is to provide a lightweight floating dock having substantial freeboard.

Another object of the invention is to provide a dock that can be easily refurbished, and also to provide a method for refurbishing existing docks.

Yet another object of the invention is to provide a wash space for debris in a floating dock structure.

Another object is to provide a floating dock structure capable of receiving a variety of deck surfaces.

A further object is to provide a floating dock structure wherein utility lines may be positioned in a fully open utility passageway prior to installation of a covering deck.

Finally, it is an object of this invention to provide a floating dock which resists the corrosive influence of the water in which it is placed.

These and other objects of the invention will be understood more clearly by reference to the following detailed description and drawings.

SUMMARY OF THE INVENTION

In accordance with an illustrated embodiment, the foregoing objects are achieved by providing a floating dock which includes a plurality of aligned float modules each having opposing walls, and an overlapping deck mounted above the float module. The float modules comprise concrete, tub-like containers containing buoyant material such as foamed plastic. A pair of wales extend along the opposing longitudinal walls of the float modules and opposing edges of the deck. In each float module, compression rods extend transversely between and act upon the pair of wales such that the compression rods exert compressive force on both the container and deck. The compression rods are positioned in the space between the deck and float module so as to provide easy access to the rods when replacement becomes necessary.

A plurality of concrete or wood beams extend between opposing walls of each float module, one below each compression rod, and each of the beams is compressively loaded by the rod. The compressively loaded beams in the plurality of modules, in combination with the opposing wales and spaced deck, provide a box beam which imparts great overall rigidity to the dock.

The float modules are spaced apart, providing a series of flow spaces beneath the deck through which debris may be washed. In addition, these spaces provide wave transparency to the dock which enhances its stability. Separation of the modules also reduces damage caused by adjacent modules bumping each other.

A reinforcing bar extends through the walls of the float module enclosure, and a plurality of lifting loops are supported by the reinforcing bar and protrude upwardly from the float module. These loops can be attached to lifting hooks for easy transportation of the float module, for example, movement of the module between a truck and the water.

The deck of the present dock can be held in place on the float modules by the compressive and frictional forces of the wales alone. In some embodiments, however, brackets are provided to securely hold the deck in place.

A significant advantage of the present structure is that the compressive loading of the modules and connecting wales throughout the length of the dock rigidifies it and increases its strength during transportation and in the marine environment on which it floats. The rigid box beam structure withstands larger waves and heavier cantilever loads than previous structures. This significant increase in strength is obtained while simultaneously desirably increasing freeboard with an elevated deck.

BRIEF DESCRIPTION OF THE DRAWINGS

FIG. 1 is a top plan view of a moorage facility employing one embodiment of the floating dock of the present invention.

FIG. 2 is an enlarged cross-sectional view of a finger float section of the dock taken along section line 2—2 of FIG. 1.

FIG. 3 is an enlarged cross-sectional view of a main walk section of the dock taken along section line 3—3 of FIG. 1.

FIG. 4 is a view similar to FIG. 3 showing a second embodiment of the dock in which side-by-side floats are provided in the main walk section.

FIG. 8 is an enlarged, fragmentary top plan view of a connection between the main walk and finger float sections of the dock of FIG. 1, the deck portions of the dock having been removed.

DETAILED DESCRIPTION OF THE PREFERRED EMBODIMENT

Figure 5:
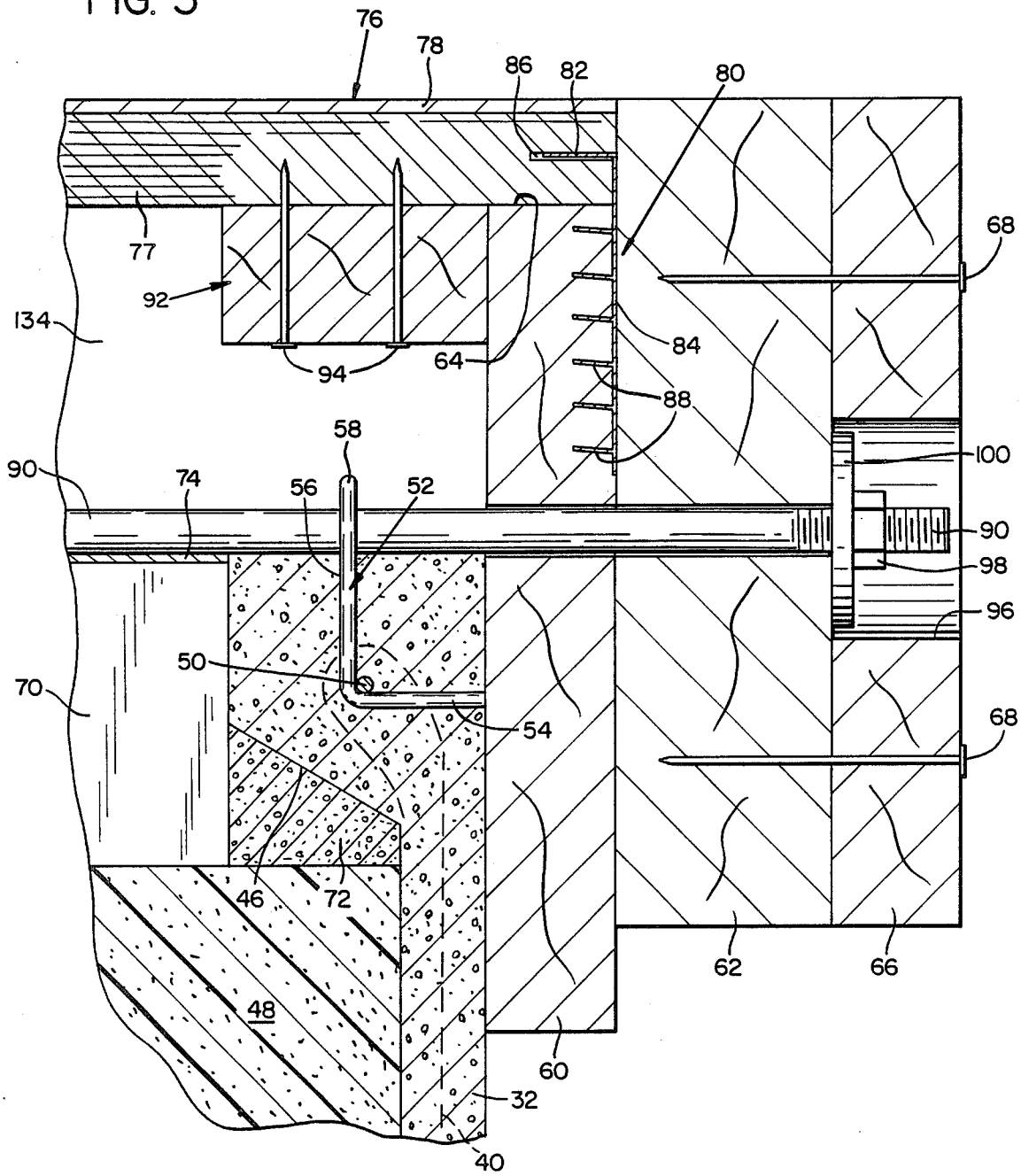
FIG. 5 is an enlarged, fragmentary, sectional view of a top corner of the dock shown in FIG. 3.

An elongated floating dock 10 is seen in FIG. 1 to include a main walk section 12 with a plurality of finger float sections 14 extending transversely thereto. Finger sections 14 are attached to the main walk section 12 by a plurality of struts 16 and brackets 17 (FIG. 8) further described below.

Main walk section 12 has opposing sides 18, 20 while finger sections 14 have opposing sides 22, 24. Boats are moored in a conventional manner within the rectangular areas defined between finger sections 14.

Figure 6:
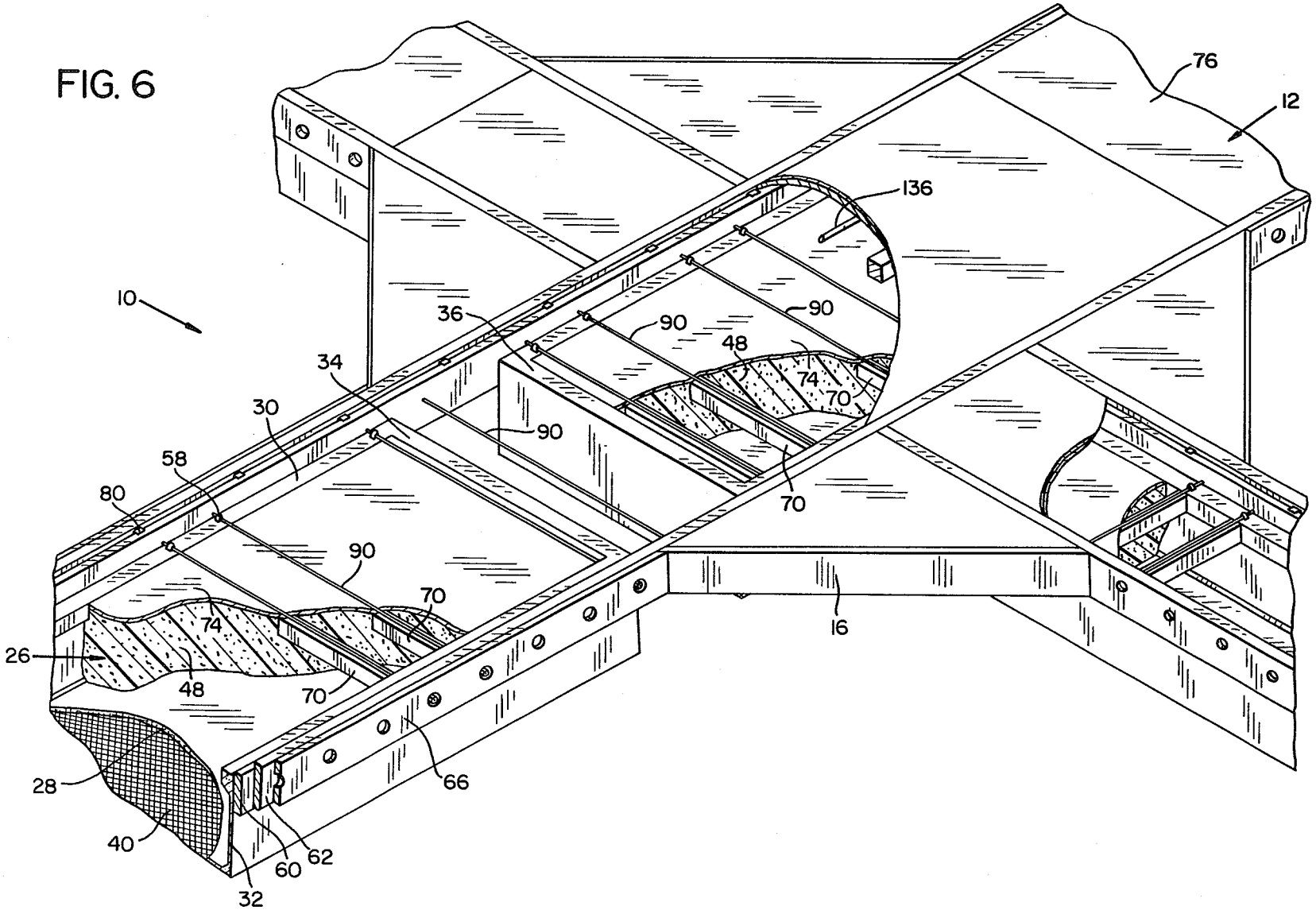
FIG. 6 is a fragmentary perspective view of a main walk portion of the dock of FIG. 1 with finger float sections attached, portions of the deck being cut away to show the arrangement of parts below the deck.

As shown in FIGS. 3 and 6, the main walk section 12 includes a plurality of float modules 26 spaced longitudinally along the dock 10, each float module comprising a rectangular tub-like, hollow concrete container 28 having opposing longitudinal sidewalls 30, 32, opposing transverse sidewalls 34, 36, and a bottom 38. The containers 28 are preferably reinforced by embedding a reinforcing mesh 40 (FIG. 6) therein, such as polypropylene or similar material inert to the corrosive attack of a marine environment. The topmost portions of each sidewall 30, 32 are enlarged to form a pair of elongated, opposing protuberances 42, 44 each having a sloping, inwardly and downwardly facing surface 46. Similar protuberances (not shown) are provided along sidewalls 34, 36. Each container 28 contains a buoyant material 48 such as, for example, one pound per cubic foot expanded polystyrene foam which fills the container.

As best seen in FIG. 5, a reinforcing bar 50 extends around container 28 through the protuberances 42, 44 of each of the float modules 26 and provides a support for a plurality of lifting loop elements 52 which protrude upwardly above the top surface of the protuberances 42, 44. As shown in FIG. 5, the lifting loop elements 52 comprise metal rods bent into an L-shape, with one leg 54 disposed horizontally below the bar 50 and the other leg 56 projecting vertically upwardly from the bar 50. The reinforcing bar 50 may be spot welded to the apex of a loop element 52 where the two legs of the L join. The upper end of a leg 56 extending above the upper surface of the walls 30, 32 is bent into a semicircular shape or loop 58, see FIG. 6, the plane of each loop 58 being parallel to the longitudinal axis of dock 10. The loops 58 provide a means for attachment of lifting hooks of a crane to facilitate movement of the containers and have a further function to be described. The loops 58 are arranged in opposed pairs, there being one pair adjacent each end of a container 28 and two pairs adjacent the center.

As shown in FIG. 5, the polypropylene mesh 40 is preferably looped around the reinforcing bar 50. Typically, a container 28 of a main walk section 12 is eight feet long, five feet in width and twenty inches deep. A container in a finger section is of similar length and depth but has a width of two and one-half feet.

As can best be seen in FIG. 6, in an assembled dock the float modules 26 are spaced apart from one another, usually by a distance of one to two feet. This space between the modules 26 provides a flow space through which debris may pass, enhances the wave transparency of the dock 10, and prevents damaging contact between adjacent members during stormy conditions.

A pair of opposing elongated wooden wales extend along the opposing longitudinal sides 18, 20 of the main walk section 12. Each of the pair of wales includes an inner wale 60 which may comprise a series of 2×10's, and an outer wale 62, which may, for example, comprise a series of 3×10's. The wales are preferably pressure treated with a preservative. The 2×10's and 3×10's of the wales overlap each other and the float modules, as indicated in FIG. 6. The wale 60 is placed lower on the sidewalls 30, 32 than is the wale 62. This arrangement of wales 60, 62 provides an upwardly facing ledge 64 (FIG. 5) for a purpose described later.

A rub board 66 covers the outside face of outer wale 62 to provide a protective member against which moored boats may bump. The rub board 66 is secured to the outer wale 62 by suitable fasteners, such as nails 68 (FIG. 5).

Referring particularly to FIGS. 3, 5, and 6, a series of parallel, transverse, wood or concrete compression beams 70 extend between opposing walls 30, 32 of each container 28, a beam being positioned in alignment with each opposing pair of lifting loops 58. In the described embodiment, four wood beams 70 extend between the protuberances 42, 44 of walls 30, 32 within notches provided in the buoyant material 48 as shown in FIG. 6. Preferably the space between the sloping protuberant surface 46 and the ends of each beam is filled with concrete 72 so as to provide and extend the area of contact between the beam ends and the walls. A covering 74 of suitable material, such as fiber cement, may be placed over the tops of the beams 70 to close the top of the container and provide a protective covering for the beams 70 and buoyant material 48.

A pedestrian deck 76 extends the length of the dock sections 12, 14. The deck 76 may comprise any suitable element such as planking or panels formed of planks or, as illustrated, a plurality of adjacent plywood panels 77 having a nonskid top surface layer 78 (FIG. 5) of fiber cement or similar material. The opposite side edges of the panels are supported on the ledges 64 previously described and snugly engage the outer wales 62, as best shown in FIG. 5. The deck panels 77 may simply be laid upon the ledge 64 and clamped in place by the engagement of the wales 62 therewith when the dock is fully assembled. However, where the dock 10 may be subjected to strong wave action, preferably the panels are held in place by a plurality of L-shaped brackets 80, each of which has a flat, horizontal first leg 82 and a vertical second leg 84. The legs 82 extend into a kerf 86 formed in the side edges of the panels. The legs 84 extend downwardly along the outer face of the inner wale 60 so that they are clamped thereagainst by the outer wale 62. The leg 84 is formed with a plurality of struck-out teeth 88 which extend into the wale 60. Thus, the deck panels 77 are firmly held in position in spaced relationship above the containers 28. Preferably the deck panels 77 are sized so as to be frictionally and compressively engaged by the opposite wales 62 when the units are assembled.

A nailer board 92 is preferably positioned beneath deck 76 on the interior face of each wale 60. In assembly, the nailer boards 92 are secured with a marine adhesive to the wales 60 before the latter are mounted to the container 28. Then nails 94 are driven through the board 92 and into the bottom of a deck panel 77 as shown in FIG. 5. Thereafter, the assembled panels 77 and wales 60 are positioned on the containers 28 and secured thereto as described below. The deck 76 is, therefore, secured to its underlying structure completely from below, without the necessity of piercing deck 76 from above with nails or other mechanical fastener. Fasteners which penetrate a deck from above tend to work themselves above the deck surface under the influence of torsional stresses caused by wave action and other environmental influences. The protruding fasteners are undesirable since they may cause a pedestrian to trip or cause injury to the foot of dock users. The structure of the application avoids this problem since the decking is either secured in place simply by clamping it between the opposite wales or by using supplemental fasteners which are entirely below the deck surface.

Extending transversely of the modules 26, one above each beam 70, are compression rods 90. The rods 90 extend through opposite lifting loops 58, through the wales 60, 62, and into openings 96 in the rub boards 66. Nuts 98 are threaded onto the cooperatively threaded ends of the rods 90 and bear against washers 100, which engage the wales 62. The nuts 98 are torqued to cause a compression force to be exerted on the opposing wales 60, 62 which force is transmitted through the container sidewalls 30, 32 to the deck 76, and compression beams 70, thereby creating a box beam structure extending the length of main walk section 12. As will be apparent, the loops 58 anchor the wales 60, 62 and the deck 76 securely to the float modules 26.

An intermediate support beam 102 (FIG. 3) extends longitudinally of main walk section 12 below deck 76 and above rods 90 to provide intermediate support for deck 76. The beam 102 provides additional support for the middle portion of deck 76 to prevent bending or bowing in response to loads on the deck.

A second embodiment of a main walk section **12*a* is shown in FIG. 4. This embodiment differs from that shown in FIG. 3 by provision of identical, side-by-side float modules 26*a*, 26*a*' each substantially identical to float module 26 of FIG. 3 but of a narrower width. Parts in FIG. 4 that correspond to similar parts in FIG. 3** have been given like numerals but are differentiated therefrom by addition of the letter "a" to each numeral.

The embodiment of FIG. 4 has an intermediate wale 108 extending longitudinally of an assembled dock 10 midway between the opposite side wales **60*a* and downwardly between the float modules 26*a* and 26*a*'. Compression rods 90*a* extend across both float modules 26*a* and 26*a*' and are secured in place and loaded similarly to the rods 90. Thus, sidewalls 30*a*, 32*a* of the modules 26*a*, 26*a*' clamp the wale 108** between them.

Referring now to FIGS. 1 and 2, each finger section 14 comprises a plurality of longitudinally spaced, float modules 110 each comprised of a hollow container 112 of approximately one-half the width of a container 28. Each has opposing sidewalls 114, 116 and a bottom 118. Each float module 110 contains buoyant material 120, such as the polystyrene foam 48. A plurality of compression beams 122 extend between opposing sidewalls 114, 116, and a deck 124 is held in spaced relationship above beams 122 by opposing, longitudinally extending wooden wales 125 comprising a pair of overlapping inner and outer wale members 126, 127, respectively, arranged similarly to wales 60, 62 along each sidewall 114, 116. The panels of the deck 124 are preferably secured in position, as shown in FIG. 5. A rub board 128 extends longitudinally along each of the opposing pair of wales 125, and compression rods 130 extend through aligned bores in wale members 126, 127 and rub board 128, with a nut 132 threaded around external threads at opposite ends of rod 130. Nuts 132 are tightened to compress wales 125 into compressing relationship against sidewalls 114, 116, thereby creating a box beam out of the combination of beams 122, deck 124, and wales 125.

A suitable arrangement for securing a finger 14 to the main walk section is shown in FIG. 8. The struts 16 are suitably bolted to the main section 12 and fingers 14, respectively. Compression rods **90, 90*a* of extended length, or additional compression rods may be added to clamp the struts, as shown in FIG. 8. In addition, angle plates 17 are bolted to the main section and finger section on each side of the latter, again using compression rods 90, 90*a* or added rods as may be desired or necessary. In this manner, the sections 12, 14** are held in fixed perpendicular relationship to one another.

Figure 7:
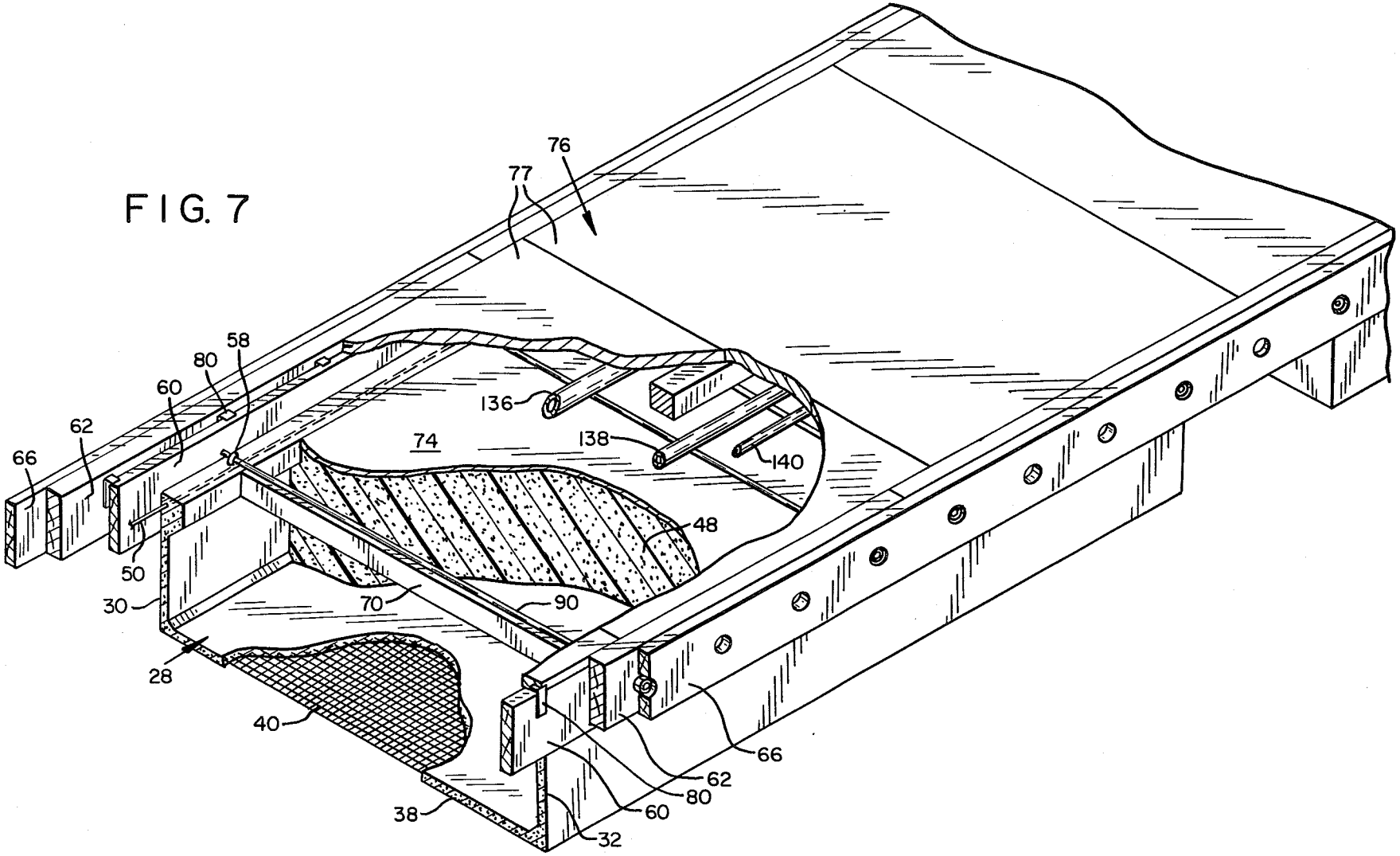
FIG. 7 is an enlarged, fragmentary perspective view of a main walk portion of the deck shown in FIG. 6, portions of the deck being cut away.

The box beam thus created in a main dock section 12 by compressively loading the containers 28, beams 70, deck 76, and wales 60, 62 creates a rigid structure that floats without substantial bending in response to environmental influences. The interior of this box beam provides a passageway 134 through utility lines, such as electrical and telephone lines and water, can be positioned, as indicated at 136, 138 and 140 in FIG. 7. A particular advantage of the structure wherein the deck 76 is simply frictionally held in place between the opposing wales is that the utility lines may be positioned in the utility passageway from the top before the deck is laid in place. Moreover, access to the passageway for service of the utilities is easily accomplished by simply loosening the nuts 98 on the compression rods to free the decking so it can be lifted off.

A box beam structure is also created in each of finger float sections 14 by compressively loading containers 112, beams 122, deck 124, and wales 125. A passageway 142 is provided between deck 124 and rods 130, and this area can also be used as a utility conduit passageway.

Conventional means (not shown) may be provided to secure the dock 10 to pilings or other structures.

An advantage in the positioning of the compression rods above the concrete walls of the float modules is that this arrangement makes practical reconstruction of existing, compressively loaded docks such as those shown in U.S. Pat. No. 4,353,320. In such reconstruction float modules, such as shown in that patent, would have their existing wales and compression rods removed. Opposing wales would then be fixed along the sides of the modules, with compression rods extending between the wales above the top surface of the float module as shown and described therein. The concrete top of the existing float shown in that patent would provide a compression beam analogous to beam 70 in FIG. 3. In this manner, a box beam structure will be created by compressive loading of the deck, wales and the concrete tops of the existing float.

The present invention enjoys several additional advantages unknown in the prior art. For example, the deck 76 is spaced above float module 26 a greater distance, whereby greater freeboard is provided for the dock 10. Since this freeboard is a result of the elevated deck structure with a utility passageway beneath the deck, float modules 26 can be smaller and lighter than in the prior art where additional freeboard could only be gained by making the concrete container taller. The lighter weight and smaller size of the containers 28 are of particular advantage during land transportation of the float modules to their ultimate destination since more containers 28 can be stacked on top of one another in a given amount of space, and transportation costs are lessened by the lighter weight of containers.

Lifting loops 58 also increase efficiency of transportation and assembly of the dock. Prior art float modules had to be moved with forklifts, making it necessary to load the float modules on a truck with several inches of clear space between the top of one member and the bottom of another to make room for the forks. The lifting loops 58 of the present invention obviate the need for a clear space between members by simply providing a place for hooking the member from above and moving it without a forklift. Elimination of fork spaces allows more floats to be stacked on top of one another upon a truck bed, especially since the space occupied by loops 58 is much less than that required for a forklift clear space. A one inch thick sheet of compressible foam padding between stacked members is sufficient to protect them from damaging each other.

Having illustrated and described the principles of the invention in a preferred embodiment, it should be apparent to those skilled in the art that the invention can be modified in arrangement and detail without departing from such principles.

I claim:

1. A floating dock, comprising:

a plurality of aligned float modules having aligned opposed walls;

a deck having opposing edges in spaced relationship above opposing edges of said float modules;

a pair of wale means extending along and in engagement with each of said opposing walls of said float modules and said opposing edges of said deck; and compression means above said float modules and below said deck extending between and acting on said pair of wale means for exerting compression force on said float modules and deck whereby said float modules, deck, and wale means form a box beam type structure under compression.

2. The dock of claim 1 further comprising compression beams extending between said opposing walls of each float module below said deck.

3. The dock of claim 1 wherein said plurality of float modules are secured to and held in spaced relationship to one another between said pair of wales.

4. The dock of claim 1 wherein each of said float modules comprises a concrete container and said compression means comprises a plurality of compression rods extending between said wale means.

5. The dock of claim 4 wherein a compression beam extends between the walls of said container below said deck, immediately beneath each of said compression rods.

6. The dock of claim 4 wherein a plurality of loops are embedded in and extend upwardly out of said opposing walls of said float modules but below said deck.

7. The dock of claim 6 wherein said loops are arranged in opposed pairs and said compression rods extend through said loops.

8. The dock of claim 6 wherein a reinforcing rod extends around and is embedded in said container and said loops are secured to said reinforcing rod.

9. The dock of claim 1 wherein said wale means each comprises an inner wale member and an outer wale member positioned side-by-side with the outer wale members extending above said inner wale members, siad inner wale members each defining a ledge, said deck extending over said ledges with said deck edges abutting said outer wale members and resting on said ledge.

10. The dock of claim 9 wherein each of said opposing edges of said deck is provided with a kerf, a plurality of L-shaped brackets each having a flat first leg and a second leg, said first leg of said bracket being inserted within said kerf and said second leg extending downwardly between said inner and outer wale members and means securing said second leg to one of said wale members, thereby to hold said deck in fixed relationship to said float module.

11. An elongated floating dock having opposing sides, said dock comprising:

a plurality of float modules spaced longitudinally along said dock, each float module being comprised of a hollow container having opposing walls, said float module containing buoyant material;

a pair of opposing, elongated wale members extending along each of the opposing longitudinal sides of said dock and defining opposed inwardly facing ledges;

a transverse compression beam extending between opposing walls of each container;

a plurality of L-shaped brackets each having a flat first leg and a second leg with sharp projections extending therefrom;

a deck mounted in spaced relationship above said float modules and extending between said wales and over said ledges, said first leg of said bracket being inserted within a kerf along a longitudinal edge of said deck, said second leg extending downwardly between said wale members, said projections of said second leg piercing a said wale member to secure said deck in fixed relationship to said float module;

a compression rod extending between and acting on said pair of wales above said floats and below said deck such that compression force is exerted on said pair of opposing wales to compress said float modules, deck, and compression beam;

and a plurality of lifting loops protruding upwardly from said walls of each of said containers to provide a means for lifting said dock and engaging said compression rods to secure the same in position on said container.

12. A method of constructing a floating dock, comprising the steps of:

providing a plurality of float modules having opposing walls;

providing a deck with opposing edges and positioning said deck in spaced relationship above said float modules;

positioning a pair of opposing wales along said opposing walls of said float modules and opposing edges of said deck; and compressing said float modules and deck with a compression means extending between and acting on said pair of wales above said float modules and below said deck such that said compression means exerts compression force above said float modules on said float modules and deck to form a box beam structure under compression.

13. The method of claim 12 wherein said floating dock is elongated and said compression is performed transverse to said dock.

14. The method of claim 13 wherein said compression means comprises compression rods extending between said opposing wales.

15. The method of claim 12 further comprising the step of providing a compression beam which extends between said opposing walls of said float modules below said deck.

16. A floating dock comprising:

a plurality of aligned float modules having aligned opposing walls;

a deck in spaced relationship above said float modules;

a pair of wale means extending along and in engagement with each of said opposing walls of said float modules and said deck;

a plurality of compression beams extending between said opposing walls of said float module;

compression means below said deck and above said modules for compressing said deck, wales, opposing walls and compression beams to form a box beam under compression.

17. The dock of claim 16 wherein said deck is held in spaced relationship above said modules by being frictionally engaged between said wales.

18. A floating dock, comprising:

a plurality of aligned float modules having aligned opposing walls;

a pair of wale means extending along and in engagement with each of said opposing walls of said float modules, each wale means comprising an inner wale member and an outer wale member positioned side-by-side with the outer wale members extending above said inner wale members, said inner wale members each defining a ledge;

a deck having opposing edges which rest on the ledges formed by said inner wale members, said opposing edges being provided with a kerf; and a plurality of L-shaped brackets each having a flat first leg and a second leg, said first leg of said bracket being inserted within said kerf and said second leg extending downwardly between said inner and outer wale members and means securing said second leg to one of said wale members, thereby to hold said deck in fixed relationship to said float module.

* * * * *

UNITED STATES PATENT AND TRADEMARK OFFICE

CERTIFICATE OF CORRECTION

PATENT NO. : 4,709,647

DATED : December 1, 1987

INVENTOR(S) : David H. Rytand

It is certified that error appears in the above-identified patent and that said Letters Patent is hereby corrected as shown below:

Title page:

In the abstract, line 6, change "dock" to --deck--.

Column 7, line 42, after "principles." insert the sentence --I claim all modifications coming within the spirit and scope of the following claims.--

Column 7, line 46, change "opposed" to --opposing--.

Column 8, line 18, change "siad" to --said--.

Signed and Sealed this

Third Day of May, 1988

*Attest:*

*Attesting Officer*

DONALD J. QUIGG

*Commissioner of Patents and Trademarks*